United States Patent [19]

Dean

[11] 4,406,454

[45] Sep. 27, 1983

[54] ARM WRESTLING APPARATUS

[75] Inventor: Jonlee R. Dean, Danville, Ind., Frances Dean, administratrix

[73] Assignee: Frances, Executrix Dean, Danville, Ind.

[21] Appl. No.: 332,407

[22] Filed: Dec. 21, 1981

[51] Int. Cl.[3] ..... A63B 21/00

[52] U.S. Cl. ..... 273/1 GC; 273/1 GI; 272/67; 272/130; 73/379

[58] Field of Search ..... 273/1 GC, 1 GI; 272/67, 272/130; 73/379-381

[56] References Cited

U.S. PATENT DOCUMENTS

| | | | |
|---|---|---|---|
| 3,400,793 | 9/1968 | Norris et al. | 73/381 X |
| 3,467,376 | 9/1969 | Feinberg | 273/1 GI |
| 4,063,726 | 12/1977 | Wilson | 272/130 |
| 4,176,837 | 12/1979 | Jeffrey et al. | 272/67 X |
| 4,184,675 | 1/1980 | Rogerson | 272/67 |
| 4,220,330 | 9/1980 | Montgomery | 273/1 GC |
| 4,327,910 | 5/1982 | Mackie | 273/1 GI |

FOREIGN PATENT DOCUMENTS

| | | | |
|---|---|---|---|
| 1035306 | 7/1966 | United Kingdom | 73/379 |

*Primary Examiner*—Paul E. Shapiro

*Attorney, Agent, or Firm*—John H. Calhoun, Jr.

[57] ABSTRACT

An arm wrestling apparatus comprising a handle that extends upward out of the top of a cabinet which handle is adapted at one end to be grasped in a person's hand and which is coupled at the other end to a gear mechanism that is, in turn, coupled to the exposed ends of piston rods of a pair of opposing pneumatic cylinders, which cylinders are pivotally mounted at their other ends to the frame of the cabinet. The top of the cabinet is provided with an elbow rest for users of the apparatus. An air compressor with its associated hoses, couplings, and controls provides a variable and controllable air pressure to the pair of pneumatic cylinders which, in turn, transmit a muscle-opposing force through the gear mechanism to the handle. Switches, timers and display lights are provided to control the operation and timing of the apparatus and to indicate the results of person's attempts to wrestle the machine.

2 Claims, 11 Drawing Figures

ARM WRESTLING APPARATUS

BACKGROUND OF THE INVENTION

Arm wrestling is an ancient individual sport in which persons test their strength and skill against one another. There is evidence of increasing interest in the sport of arm wrestling, and international competitions are held from time to time in various locations within the United States and in Japan and several European countries. A common problem of arm wrestlers and those who would adopt the sport is the lack of suitable equipment and opportunities to practice and to develop their strength and skills.

Exercising machines are well known in the art. U.S. Pat. No. 2,825,563 issued on Mar. 4, 1958 to H. R. Lawton shows an exercising machine for simultaneously exercising the back, leg and arm muscles. This machine employs a pneumatic cylinder and has provisions for varying the amount of effort required to operate the machine. U.S. Pat. No. 3,369,403 issued on Feb. 20, 1968 to E. M. Carlin et. al. shows a hydraulic muscle strength developing apparatus equipped with an operating handle to permit a user to resist movement of a piston caused by the introduction of pressurized hydraulic fluid into the opposite end of a cylinder. U.S. Pat. No. 3,495,824 issued on Feb. 17, 1970 to H. A. Cuinier shows a fluid resistant type exercising device wherein the resistance produced by a fluid flowing through a constriction provides a muscle-opposing force in either of two directions. U.S. Pat. No. 3,822,599 issued on July 9, 1974 to Jerry D. Brentham shows an exercising device comprising a handle pivotally mounted on a frame with a hydraulic system connected to the handle to exert a regulated force restraining movement of the handle. U.S. Pat. No. 4,184,675 issued on Jan. 22, 1980 to Brent Rogerson shows a mechanical arm wrestler comprising a hydraulic cylinder mounted on a base and crank arm pivotally mounted on the base and connected through a rod to the cylinder. Also known in the art are dead weight devices and spring loaded devices for developing the muscles used in arm wrestling. The present invention provides a novel apparatus that is especially useful for controllably developing the strength and skills required in arm wrestling and for measuring a person's abilities and progress in this regard.

SUMMARY OF THE INVENTION

The apparatus of the present invention has all of the advantages of arm exerciser and arm wrestling devices known in the art for developing the strength and skills required in arm wrestling and for measuring a person's abilities and progress in that regard, and in addition it provides several distinct and important advantages not provided by existing devices. One object of the present invention is to provide an apparatus that allows a user to perfectly simulate arm wrestling with another individual. Another object of the present invention is to provide an apparatus capable of presenting accurate, precise, and quantitative information regarding a user's arm wrestling capabilities. Another object of the present invention is to provide an infinitely variable and controllable resistance against which a user may exercise or test his strength. Another object of the present invention is to provide an apparatus that is adapted for commercial use by persons who are casually interested in arm wrestling as well as those who are more seriously interested in the sport. Another object of the present invention is to provide a means for instantly presenting to the user indications and measures of his arm wrestling abilities. Another object of the present invention is to provide an arm wrestling apparatus that is simple in construction, inexpensive, strong and durable, accurate and precise, reliable, and well adapted for the purposes for which it is designed. Other objects and advantages of the present invention will become apparent from a consideration of the following detailed description taken in connection with the accompanying drawings were in a preferred embodiment of the invention is shown. It should be understood that the invention is not limited to the details disclosed, but includes all such variations and modifications as fall within the spirit of the invention and the scope of the appended claims.

The objects of the present invention are accomplished by providing an electrically controlled and pneumatically operated arm wrestling lever or handle that extends upward out of the top of a cabinet that houses mechanical and electrical components needed to operate and control the apparatus. The top of the cabinet is provided with an elbow rest, and a pair of opposing pneumatic cylinders located within the cabinet and served by an air compressor transmit a muscle-opposing force to the handle through a gear assembly.

BRIEF DESCRIPTION OF THE DRAWINGS

A preferred embodiment of the present invention is illustrated in the accompanying drawings in which.

DESCRIPTION OF THE PREFERRED EMBODIMENT

Figure 1:
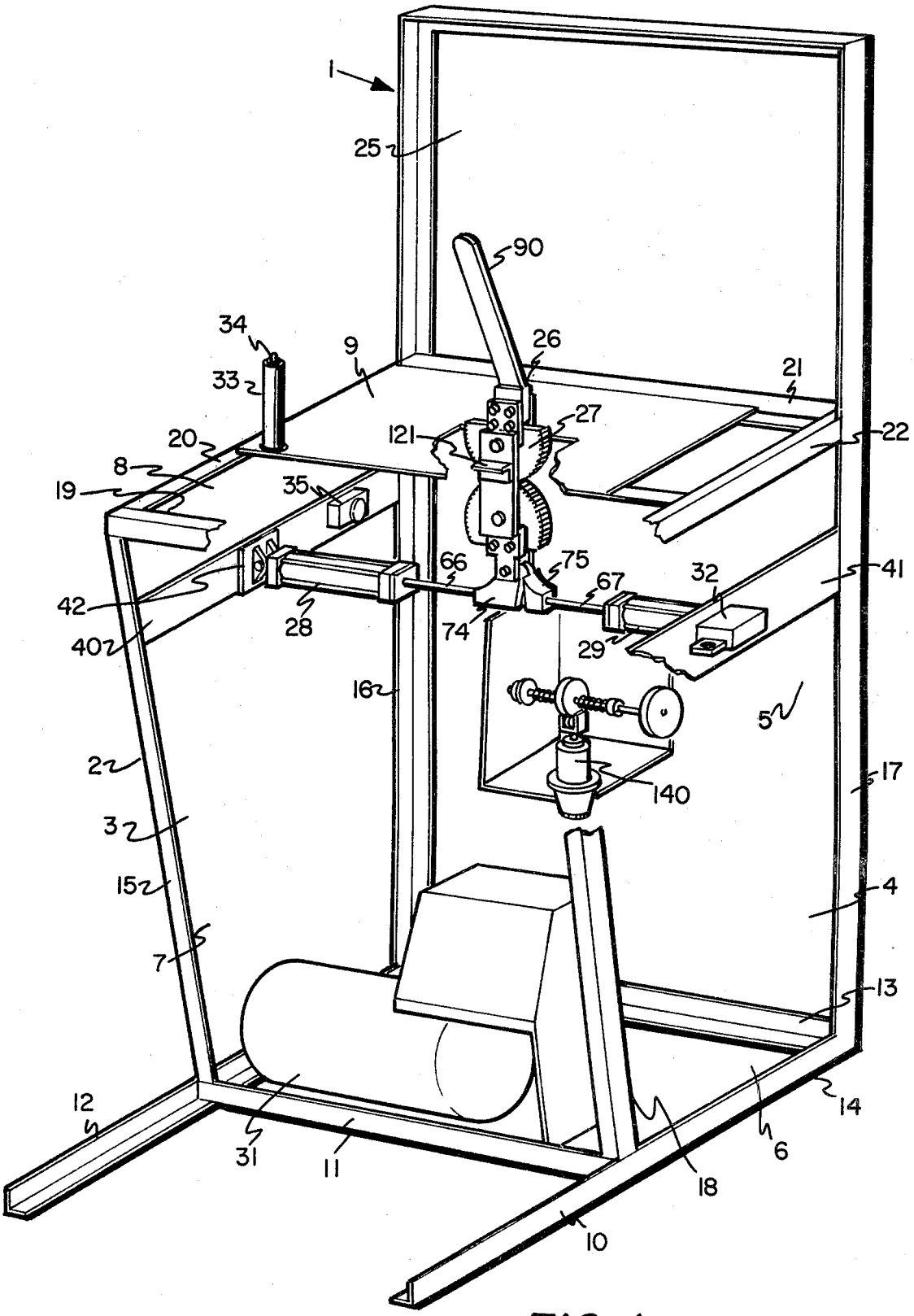
FIG. 1 is a fragmentary view in perspective of the arm wrestling apparatus of the present invention.

Referring now to the drawings in greater detail, FIG. 1 illustrates a preferred embodiment of my invention, shown generally at 1. The apparatus of the present invention comprises a cabinet 2 (with walls removed) having two sides 3, 4, a back 5, a bottom 6, a front 7, and a top 8. A portion of the top 8 comprises a gear mechanism support plate 9. The cabinet 2 includes a frame 10 comprising a plurality of structural members 11–22 such, for example, as steel angles welded or otherwise suitably joined together. Also provided are a backboard display box 25, an arm assembly 26, a gear assembly 27, a pair of opposing operating pneumatic cylinders 28, 29, a locking cylinder 30 (shown in FIG. 7), and air compressor 31, a coin-actuated switch 32, a handhold 33 and thumb-actuated start switch assembly 34, a timer 35, and a plurality of pneumatic hoses and couplings, solenoids, electrical switches and other assessory items hereinafter described in detail. A pair of cylinder support plates 40, 41 are welded or otherwise suitably joined to opposite sides of the frame 10, and a cylinder support bracket 42, 43 is welded or otherside suitably attached to each plate 40, 41.

Figure 2:
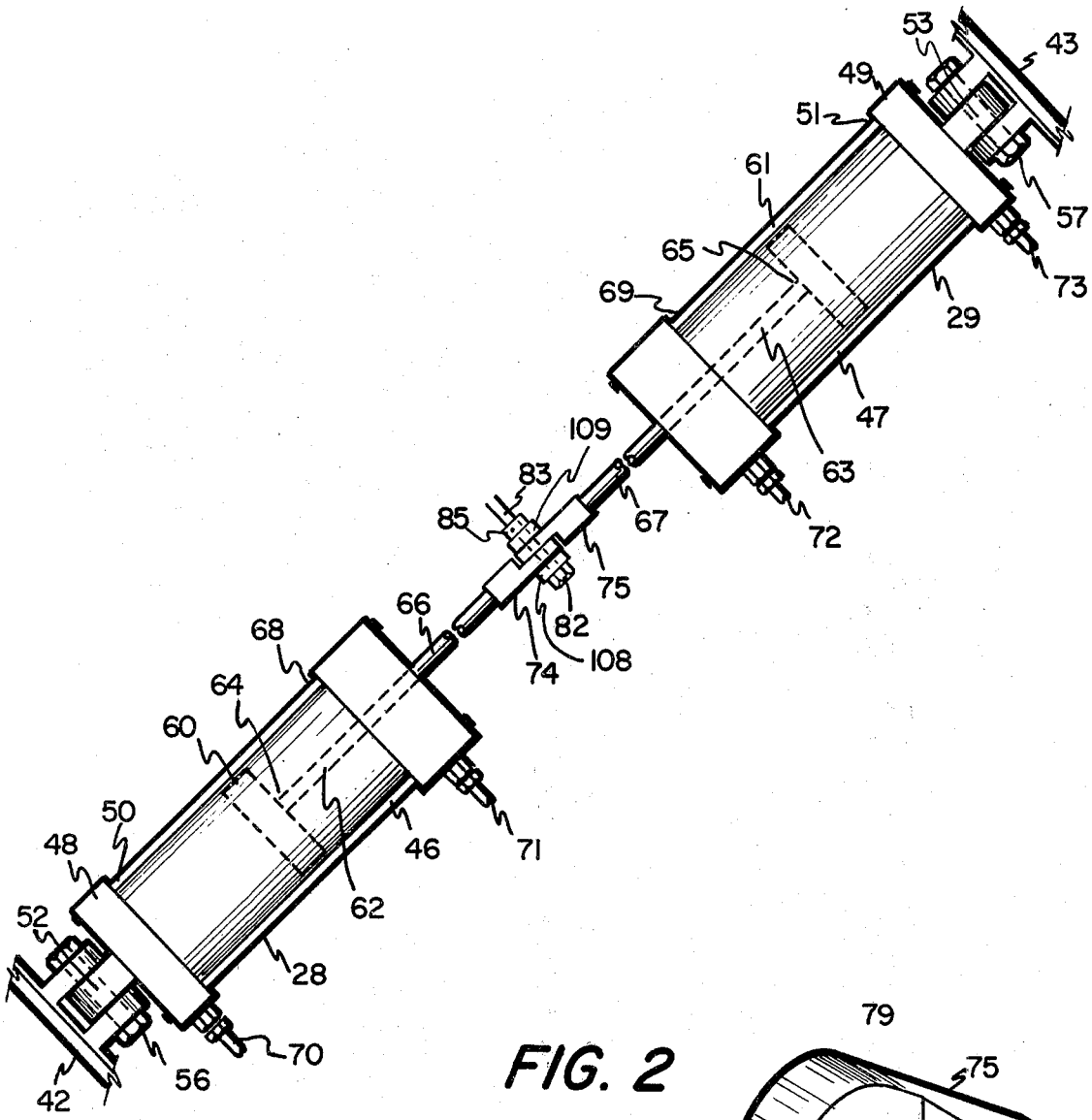
FIG. 2 is a top plan view of a pair of opposing pneumatic cylinders.

FIG. 2 illustrates the pair of opposing pneumatic cylinders 28, 29 each of which comprises a hollow tubular member 46, 47 having a head plate 48, 49 welded or otherwise secured to one end 50, 51 thereof to seal the said end 50, 51. Each head plate 48, 49 has attached thereto an ear 52, 53, for pivotally securing the cylinders 28, 29 by bolts 56, 57 to the cylinder support brackets 42, 43. A piston 60, 61 is slideably mounted within each hollow tubular member 46, 47. A piston rod 62, 63 is pivotally connected at one end 64, 65 to each piston 60, 61 and the other end 66, 67 of each piston rod 62, 63 extends from the rod end 68, 69 of its cylinder 28, 29. The rod end 68, 69 of each cylinder 28, 29 is sealed by conventional means to prevent the escape of high pressure air. Each piston 60, 61 and rod 62, 63 combination is capable of reciprocating lengthwise movement within its tubular member 46, 47. Pneumatic hose connection 70, 71, 72, 73 are provided at opposite ends of each cylinder 28, 29 for the introduction of pressurized air from an air compressor 31. It is not necessary that the pneumatic cylinders 28, 29 used in my arm wrestling apparatus 1 be further described, since pneumatic cylinders are well known and the cylinders 28, 29 used in my invention are of conventional construction.

Figure 3B:
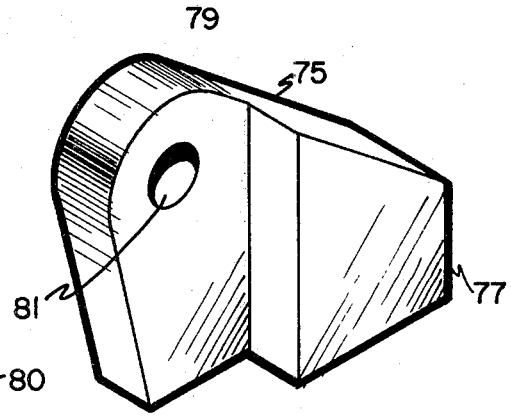
FIG. 3B is a view in perspective of a second pivot eye.
Figure 3A:
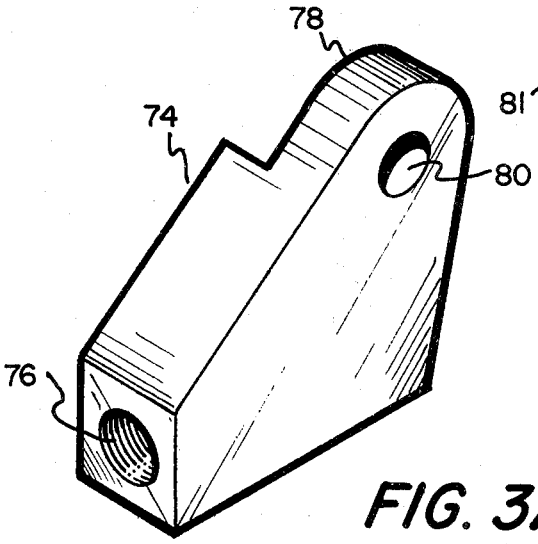
FIG. 3A is a view in perspective of a first pivot eye.

The exposed end 66, 67 of each piston rod 62, 63 is threaded and is provided with a cylinder pivot eye 74, 75 attached thereto. As illustrated in FIGS. 3A and 3B, each pivot eye 74, 75 is provided with a hole 76, 77 which is threaded to receive the threaded ends 66, 67 of the piston rods 62, 63. Each eye 74, 75 has an ear portion 78, 79 having a hole 80, 81 therethrough adapted to receive a bolt 82 removeably inserted therein for pivotally connecting each eye 74, 75 to the other 75, 74 thus providing for rotational and pivotal movement of the eyes 74, 75 about the shaft 83 of the bolt 82 held in place by a nut 85.

Figure 4:
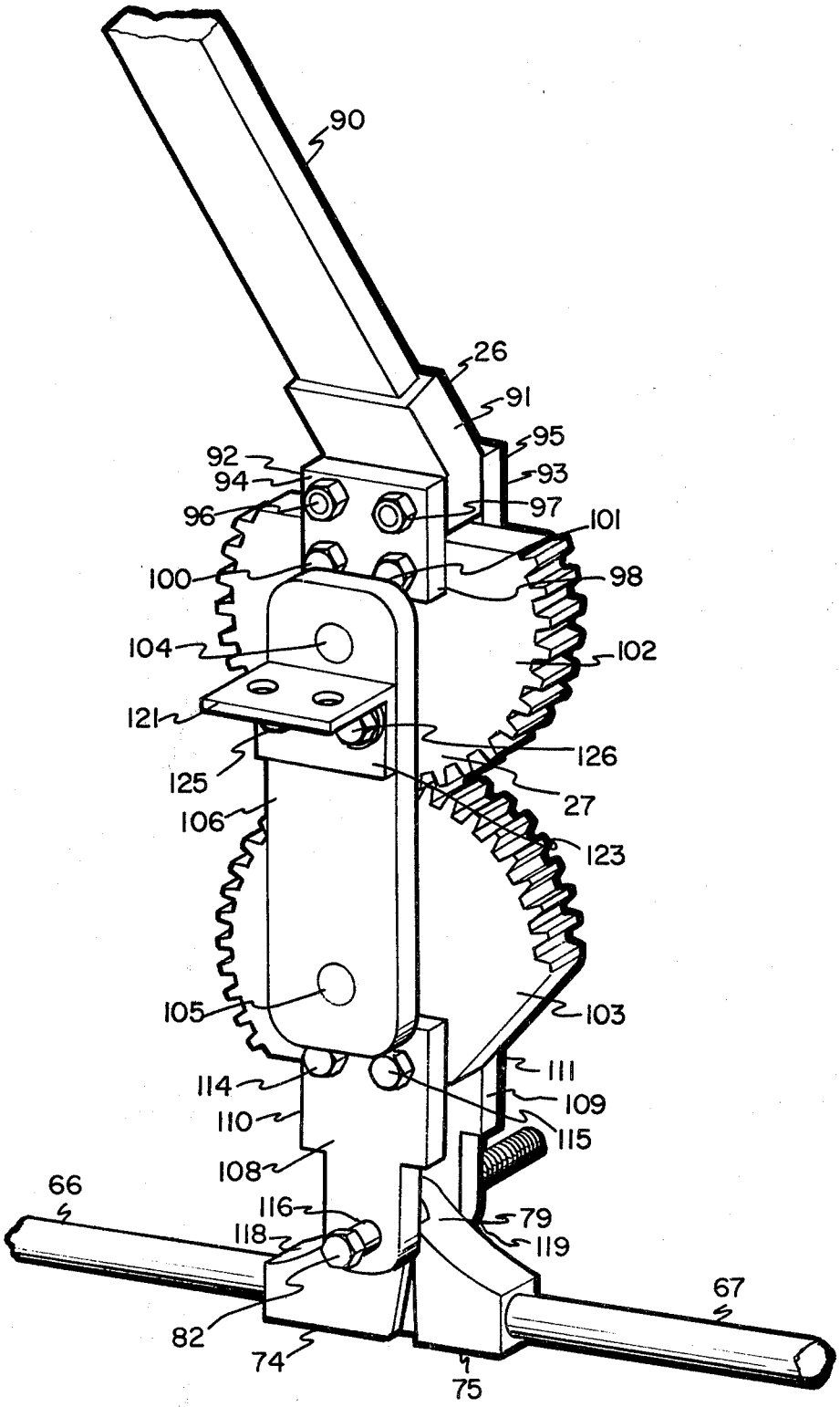
FIG. 4 is a view in perspective of arm and gear mechanisms.

Referring now to FIG. 4, the arm assembly 26 comprises a rod like handle 90 angularly welded or otherwise attached to a handle based 91. Two handle-to-gear brackets 92, 93 are rigidly attached at one end 94, 95 by bolts 96, 97 to the handle base 91. The other end 98, 99 of each handle-to-gear bracket 92, 93 is rigidly attached by bolts 100, 101 to a first gear 102 that is rotational coupled to a second gear 103 so that the second gear 103 may be driven by the first gear 102 in the usual way. The two gears 102, 103 are mounted for rotation on gear shafts 104, 105, with shafts 104, 105 attached in turn, to and supported by a pair of gear side plates 106, 107, one of which is located on each side of the two gears 102, 103. A pair of gear-to-cylinder brackets 108, 109 is also provided. One end 110, 111 of each bracket 108, 109 is rigidly attached by bolts 114, 115 to the second gear 103. A bolt hole 116, 117 is provided through the other end 118, 119 of each gear-to-cylinder bracket 108, 109. The ear portions 78, 79 of the pivot eyes 74, 75 are inserted between the gear-to-cylinder brackets 108, 109; the holes 80, 81 in the ear portions 78, 79 of the pivot eyes 74, 75 are aligned with the bolt holes 116, 117 in the gear-to-cylinder brackets 108, 109; and a bolt 82 secured by a nut 85 is inserted through the four holes 80, 81, 116, 117, thus coupling the pivot eyes 74, 75 to the arm and gear assemblies 26, 27. The gear mechanism support plate 9 is welded or otherwise suitably secured to the top of the frame 10 as shown in FIG. 1. A pair of like gear assembly support brackets 121, 122 is provided as shown in FIGS. 1 and 4. In the illustrated embodiment, each gear assembly support bracket 121, 122 comprises a short length of steel angle, one side 123, 124 of which is secured by bolts 125, 126, 127, 128 to a gear side plate 106, 107, and the other side 129, 130 of which is bolted to the gear mechanism support plate 9.

It will be readily seen that rotating the handle 90 in a counter-clockwise direction will cause the first gear 102 to rotate counter-clockwise on its shaft 104; the second gear 103 to rotate clockwise on its shaft 105; rod 66 to slide into its cylinder 28; rod 67 to slide out of its cylinder 29; and the cylinder pivot eyes 74, 75 to rotate in opposite directions on the shaft 83 of the bolt 82. In a manner that is fully described below, a controlled level of pneumatic pressure is introduced into the head end 50 of operating cylinder 28 and into the rod end 65 of operating cylinder 29 to resist counter-clockwise rotation of the handle 90. By repeatedly rotating the handle 90 in opposition to increasing levels of pneumatic pressure in the operating cylinders 28, 29, a person may develop the muscles used in arm wrestling. The arm wrestling strength of an individual may be determined by measuring the maximum pneumatic pressure against which such individual may successfully operate the arm or the number of times he or she can overcome a prescribed level of pneumatic pressure with some specified time interval.

Figure 5:
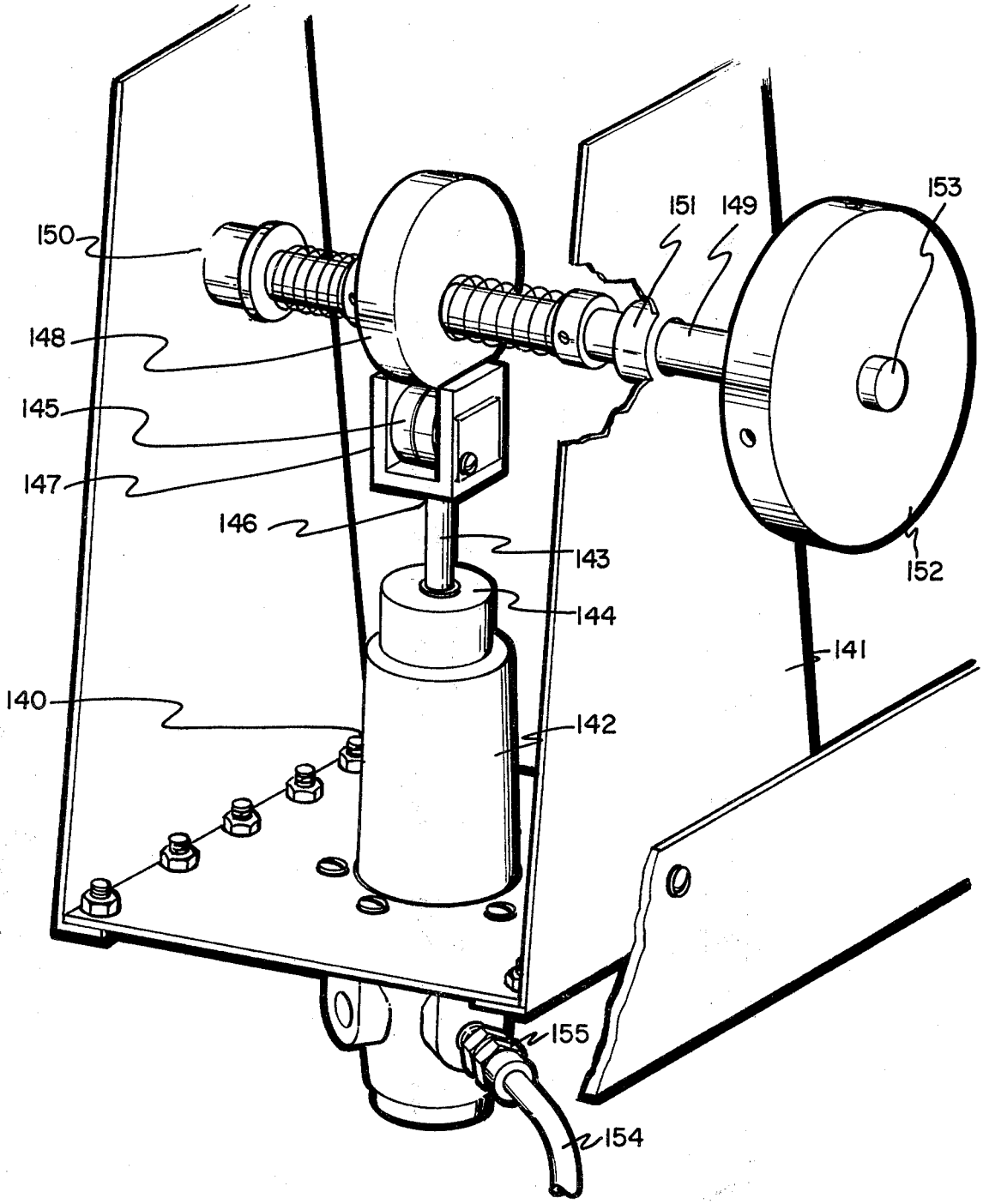
FIG. 5 is a view in perspective of an air pressure regulator assembly.

An air compressor 31 and an air pressure regulator assembly 140 are mounted within the cabinet as illustrated in FIG. 1. The pressure regulator assembly 140, shown in greater detail in FIG. 5, comprises a regulator mounting bracket 141 bolted or otherwise secured to the cabinet 2, a commercially available air pressure regulator 142 having a pressure control rod 143 projecting from one end 144 thereof, a roller bracket 147 mounted on the exposed end 146 of the said rod 143, a roller 145 rotationally mounted within the said roller bracket 147, a cam 148 rigidly mounted on a shaft 149 that is supported for rotational movement about its longitudinal axis in a pair of bushings 150, 151 positioned in the regulator mounting bracket 141. The shaft 149 is provided with a knob 152 attached to one end 153 thereof. The knob 152 is positioned external to the cabinet 2 and is adapted to be conveniently reached and turned by a user of the arm wrestling apparatus 1 to adjust the level of muscle-opposing pneumatic pressure in the operating cylinders 28, 29. The output of the compressor 31 is coupled in the conventional manner to the regulator 142 by means of an air hose 154 that terminates in a hose coupling 155. An output hose 156 (not shown) coupled to the output of the regulator 142 provides pressurized air for the pneumatic system.

Figure 6:
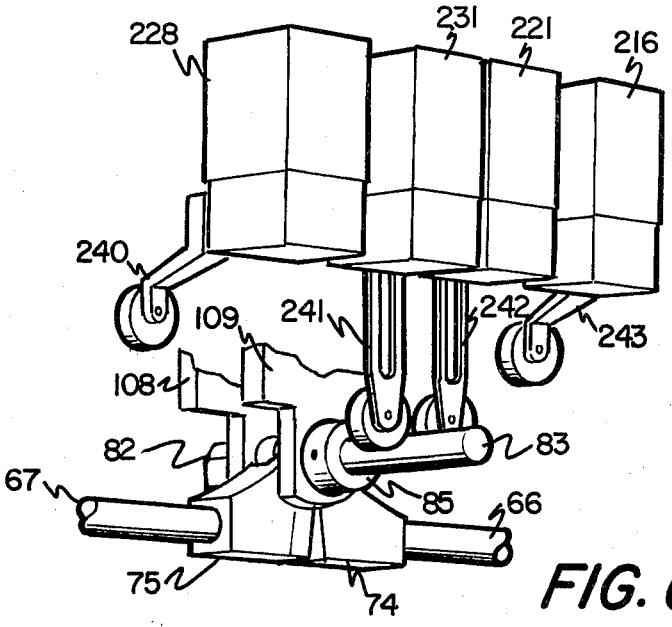
FIG. 6 is a view in perspective of a limit switch assembly.

FIG. 6 is a rear view in perspective of a limit switch assembly comprising a win indicator limit switch 228, a win centering limit switch 231, a loss centering limit switch 221, and loss indicator limit switch 216. Each switch 228, 231, 221, 216, is provided with a depending arm 240, 241, 242, 243 by which the switch 228, 231, 221, 216 may be operated by the shaft 83 of the bolt 82 that couples the pivot eyes 74, 75, together. Reciprocating movement of the pistons 60, 61 and rods 66, 67 within their respective operating cylinders 28, 29 causes the bolt 82 to swing through an arc as the operating cylinders 28, 29 pivot on the shafts of the bolts 56, 57 that couple them to their respective support brackets 42, 43. The functions and operations of the limit switches 228, 231, 221, 216 are described below.

Figure 7:
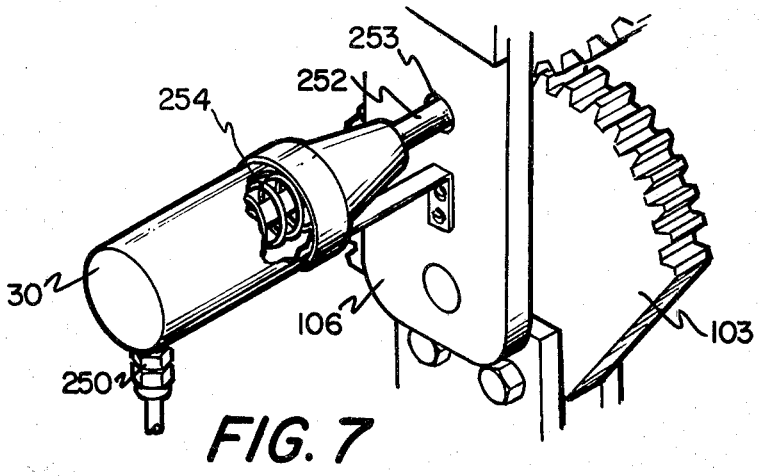
FIG. 7 is a view in perspective of a locking cylinder assembly.

FIG. 7 illustrates a pneumatic locking cylinder 30 comprising a hollow tubular member having a sealed head end having provided therein a pneumatic hose connector 250 adapted to receive pressurized air into the said head end, a piston slidably mounted within the said hollow tubular member for reciprocating lengthwise movement therein, a piston rod 252 attached to one end of the said piston and adapted at the other end to extend outside of the said cylinder and to be inserted into a hole 253 through a gear side plate 106 and the second gear 103 to engage and lock the second gear 103, and a retaining spring 254 adapted to retain the piston rod in a retracted position within the cylinder. Air may be introduced into the head end of the cylinder with sufficient pressure to overcome the resistance of the retaining spring 254, thereby forcing the rod 252 out of the cylinder and the end thereof to enter the hole 253 in the gear side plate 106 and second gear 103 thereby locking the gear assembly. Removal of air pressure in the head end of the cylinder allows the retaining spring to return the rod 252 to its retracted position within the cylinder, thereby unlocking the gear assembly.

Figure 10:
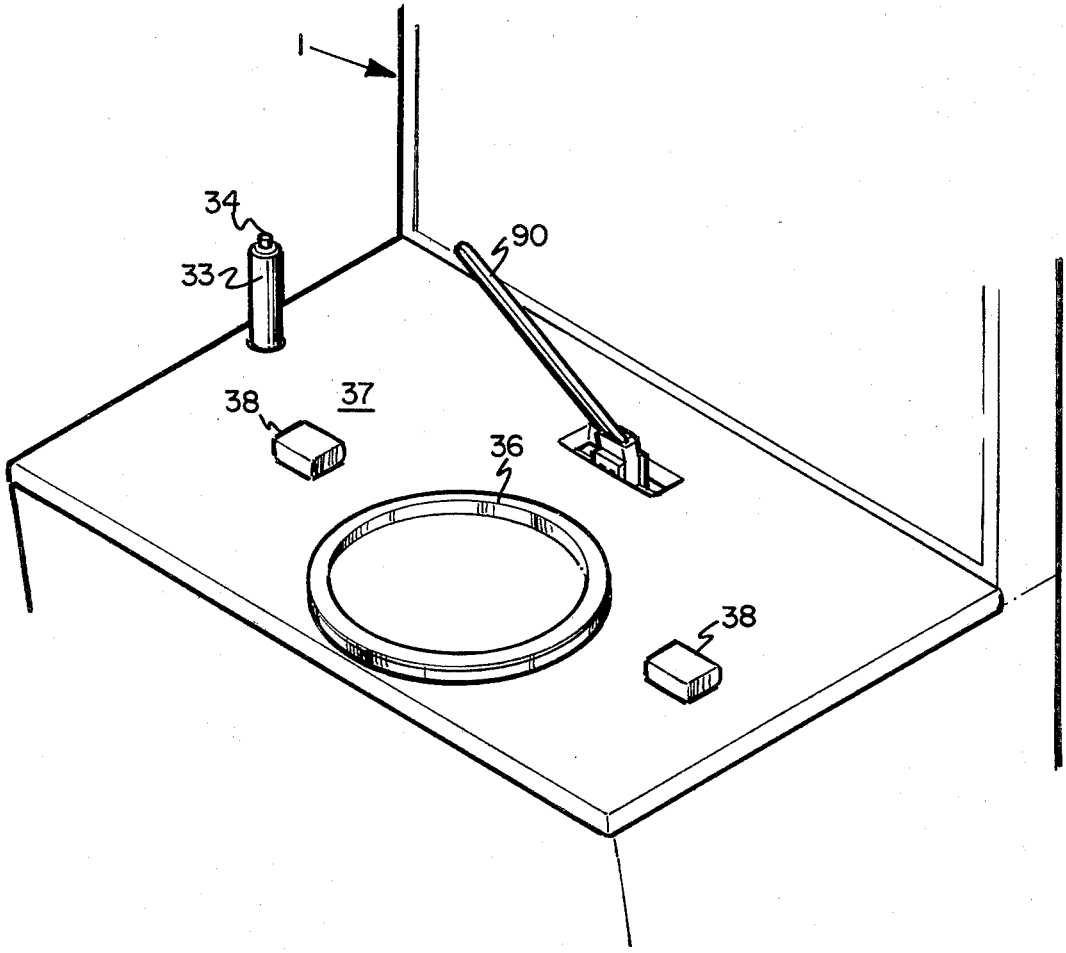
FIG. 10 is a view in perspective of the top of the arm wrestler apparatus.

Referring to FIGS. 1 and 10, a right-handed user of the arm wrestling apparatus 1 of my invention stands or sits in front of the apparatus 1, places a coin in the coin operated switch 32, grasps the handhold 33 with his left hand, places his right elbow on an elbow rest 36 on the top 8 of the cabinet 2, grasps the handle 90 is his right hand, exerts a force on the handle 90 with his right hand to rotate the handle 90 in a counter-clockwise direction, and pushes the start button 34 with his left thumb. Pressurized air in the head end 50 of the first operating pneumatic cylinder 28 and in the rod end 65 of the second operating pneumatic cylinder 29 will oppose the force exerted on the handle 90 by the user's right hand. The user may be overcome by the opposing pressure, in which case the handle 90 will rotate in a clockwise direction, and after a prescribed amount of clockwise rotation the handle 90 will engage and trip the loss indicator limit switch 216, hereinafter functionally described. A successful user will overcome the resistance, and rotate the handle counter-clockwise, and after a prescribed amount of counter-clockwise rotation the handle 90 will engage and trip a win indicator limit switch 228, also hereinafter functionally described. If the user "loses" to the machine, a loss indicator light comes on and if he or she "beats" the machine, a win indicator light comes on, along with a second light indicating the level-of-difficulty, which is measured in terms of the level of air pressure overcome by the user. After a win or loss is registered, the handle is automatically returned to a vertical position for another try. A user may repeat the sequence until the time set on the timer 35 expires. The top 8 of the cabinet 2 is provided with pads 37, 38 of resilient material for the comfort and convenience of users.

Figure 8:
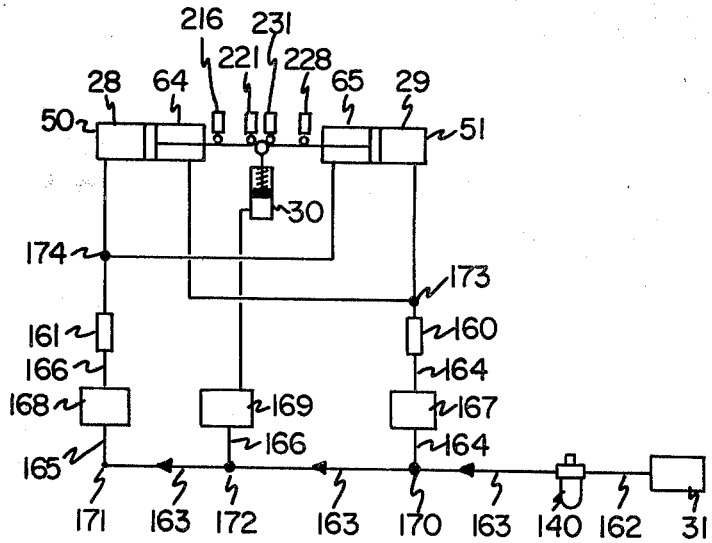
FIG. 8 is a schematic diagram of the pneumatic system.

FIG. 8 is a schematic diagram of the pneumatic system comprising an air compressor 31, an air pressure regulator 140, first and second operating pneumatic cylinders 28, 29, and a locking cylinder 30, all interconnected in the manner shown by air lines 162, 163, 164, 165, 166. The compressor 31 and regulator 140 provided an infinitely controllable pressure regulated air supply to a primary line 163 having three branch lines 164, 165, 166 at points 170, 171, 172 along its length. A first branch line 164 supplies pressurized air to the rod end 64 of the first operating cylinder 28 and to the head end 51 of the second operating cylinder 29 through a check valve 160 in line with a normally open first solenoid operated valve 167. A second branch line 165 supplies pressurized air to the head end 50 of the first operating cylinder 28 and to the rod end 65 of the second operating cylinder 29 through a check valve 161 in line with a normally open second solenoid operated valve 168. A third branch line 166 supplies pressurized air to the head end of the locking cylinder 30 through a third normally opened solenoid operated valve 169. I employ commercially available solenoid operated valves having escape ports that operate when a valve is closed to release pressurized air in the line.

When a user is ready to use the apparatus he closes a start switch by means of a button 34 on the handhold 33, energerizing solenoids for the first and third solenoid operated valves 167, 169 thereby closing off the first and third branch line 164, 166. Closing of the first branch line reduces the air pressure in the rod end 64 of the first operating cylinder 28 and in the head end 51 of the second operating cylinder 29 thereby introducing a pressure differential in opposition to the force applied to the handle by the user. Closing of the third branch line releases the locking cylinder 30, thereby unlocking the gear assembly.

Figure 9:
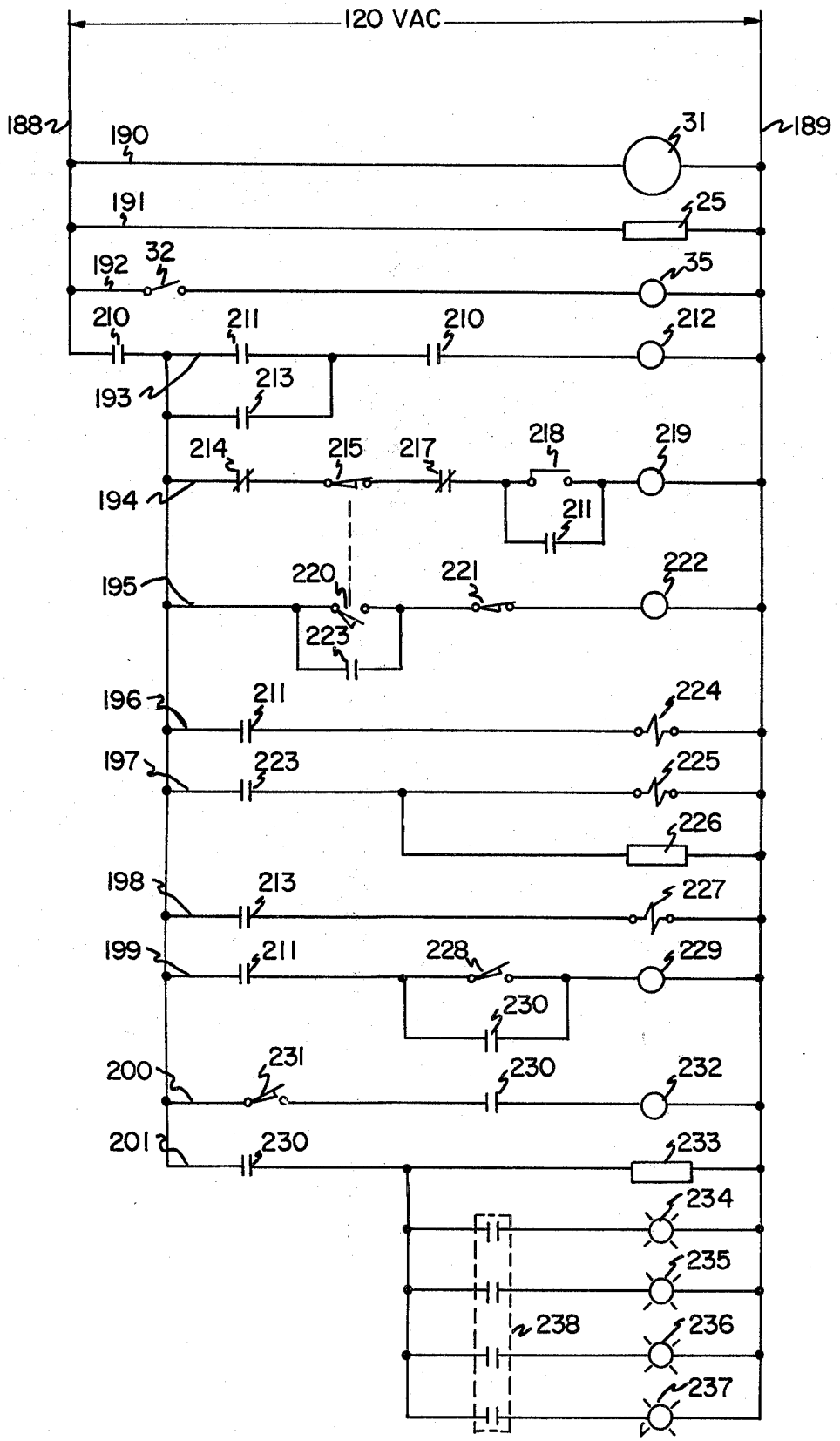
FIG. 9 is a schematic diagram of the electrical system.

FIG. 9 is a schematic diagram of the electrical system of the arm wrestling apparatus of the present invention. The electrical system comprises a plurality of parallel electrical circuits 190, 191, 192, 193, 194, 195, 196, 197, 198, 199, 200, 201 supplied by a pair of electrical wires 188, 189 connected to any 120 volt, 60 cps A/C power source.

A compressor circuit 190 comprises an air compressor 31 that supplies pressurized air to the above described pneumatic system.

A lighting circuit 191 provides illumination for the backboards 25.

A timer circuit 192 comprises a coin-operated switch 32 wired in series with a timer 35 having a normally open timer switch 210. The coin-operated switch 32 and timer 35 may be mounted at any convenient locations on or within the cabinet 2.

The said timer switch 210 is wired into the power supply line 188 between the timer circuit 192 and a locking cylinder control circuit 193. Except for the air compressor and backboard lighting circuits 190, 191, no circuit is energized except when the timer 35 is on.

A locking cylinder control circuit 193 comprises a locking cylinder relay coil 212 wired in series with a normally open start button relay switch 211 and the timer switch 210. A normally open locking cylinder relay switch 213 shunts the start button relay switch 211.

A first loss sequence circuit 194 comprises a normally closed first loss indicator relay switch 214 in series with a normally closed first pole 215 of a double pole loss indicator limit switch 216, a normally closed stop switch 217, a normally open start button switch 218, and a start button relay coil 219 which operates the start button relay switch 211. The start button relay switch 211 shunts the start button switch 218.

A second loss sequence circuit 195 comprises a normally open second pole 220 of the aforesaid double pole loss indicator limit switch 216 wired in series with a normally closed loss centering limit switch 221 and a loss indicator relay coil 222, which operates the normally closed first loss indicator relay switch 214, and a normally open second loss indicator relay switch 223 which shunts the second pole 220 of the loss indicator limit switch 216.

A first solenoid circuit 196 comprises a first solenoid 224 wired in series with the start button relay switch 211.

A second solenoid circuit 197 comprises a second solenoid 225 parallelled by a loss indicator light 226, both in series with the normally open second loss indicator relay switch 223.

A third solenoid circuit 198 comprises a third solenoid 227 in series with the locking cylinder relay switch 213.

A first win sequence circuit 199 comprises a win indicator limit switch 228 in series with the start button relay switch 211 and a win indicator relay coil 229 that operates a normally open win indicator relay switch 230. The win indicator relay switch 230 shunts the win indicator limit switch 228 in the first win sequence circuit 199.

A second win sequence circuit 200 comprises a win centering limit switch 231 in series with the win indicator relay switch 230 and a stop relay coil 232 that operates the normally closed stop relay switch 217 in the first loss sequence circuit 194.

A third win sequence circuit 201 comprises a win indicator light 233 in parallel with a plurality of level-of-difficulty lights 234, 235, 236, 237 which level-of-difficulty lights are selectable by a rotary selector switch 238, all in series with the win indicator relay switch 230.

The air compressor and backboard lighting circuits 190, 191 are energized anytime that the arm wrestler apparatus 1 is plugged into a power source. The timer circuit 192 is energized by placing a coin in and thereby closing the coin-operated switch 32. Current flow in the timer circuit 192 causes the timer switch 210 in the power line 188 and locking cylinder circuit 193 to close.

Momentary manual closing of the start button switch 218 in the first loss sequence circuit 194 will allow current flow through the circuit 194 to the start button relay coil 219 to operate and close the start button relay switch 211. Subsequent release of the start button switch 218 will not interrupt current flow to the start button relay coil 219 since the start button relay switch 211 shunts the start button switch 218 and will remain closed so long as the timer 35 is on and the timer switch 210, first loss indicator relay switch 214, loss indicator limit switch 215, and stop relay switch 217 are all closed. Closing of the start button relay switch 211 in the locking cylinder control circuit 193 when the timer 35 is on and the timer switch 210 is closed will allow current flow to the locking cylinder relay coil 212 to operate and close the locking cylinder relay switch 213. Subsequent opening of the start button relay switch 211 will not interrupt current flow to the locking cylinder relay coil 212. Closing of the locking cylinder relay switch 213 in the third solenoid circuit 198 allows current flow to the third solenoid 227 to close the third normally open solenoid operated valve 169 and thereby interrupt the flow of pressurized air to the locking cylinder 30, which allows the spring to retract the piston rod thereby releasing and unlocking the gear assembly, which will remain released so long as there is current flow to the locking cylinder relay coil 212 in the locking cylinder control circuit 193 and the locking cylinder relay switch 213 remains closed.

Closing of the start button relay switch 211 in the first solenoid circuit 196 allows current flow to the first solenoid 224 which closes the first normally open solenoid operated valve 167 thereby interrupting the flow of pressurized air to the rod end 64 of the first operating pneumatic cylinder 28 and to the head end 51 of the second operating pneumatic cylinder 29, thereby introducing a pressure differential in the operating cylinders 28, 29 opposing the force exerted on the handle 90 by the user.

If the pressurized air overcomes the user, the arm 90 will rotate in such manner as to trip the double pole loss indicator limit switch 216 thereby opening the first pole 215 of the said switch 216 in the first loss sequence circuit 194 and closing the other pole 220 in the second loss sequence circuit 195. Opening of the first pole 215 of the loss indicator limit switch 216 in the first loss sequence circuit 194 will interrupt current flow to the start button relay coil 219, thereby causing the start button relay switch 211 to open in the locking cylinder control circuit 193, the first loss sequence circuit 194, the first solenoid circuit 196, and the win sequence circuit 199. Opening of the start button relay switch 211 will have no immediate effect in the locking cylinder control circuit 193 since the switch 211 is bypassed by the locking cylinder relay switch 213; however when the time set on the timer 35 expires, the timer switch 210 will open, interrupting current flow to the locking cylinder relay coil 212 thereby opening the locking cylinder relay switch 213. Opening of the locking cylinder relay switch 213 in the third solenoid circuit 198 will interrupt current flow to the third solenoid 227 thus opening the third solenoid operated valve 169 and allowing pressurized air to flow to the locking cylinder 30 to lock the gear assembly until the start button switch 218 in the first loss sequence circuit 194 is again closed by pushing the start button 34. Opening of the start button relay switch 211 in the first loss sequence circuit 194 will prevent further current flow to the start button relay coil 219 until the start button switch 218 is momentarily closed again. Opening of the start button relay switch 211 in the first solenoid circuit 196 will interrupt current flow to the first solenoid 224 thereby opening the first solenoid operated valve 167 and allowing the flow of pressurized air to the rod end 64 of the first operating pneumatic cylinder 28 and to the head end 51 of the second operating pneumatic cylinder 29, thus encouraging the handle to resume a vertical position. Opening of the start button relay switch 211 in the win sequence circuit 199 prevents current flow to the win indicator relay coil 229, thereby preventing the occurence of a sequence of events described below that occur when a user overcomes the pressurized air and "wins".

Closing of the second pole 220 of the loss indicator limit switch 216 in the second loss sequence circuit 195 will allow current flow to the loss indicator relay coil 222 to operate and close the second loss indicator relay switch 223 in the second loss sequence circuit 195 and the second solenoid circuit 197. Subsequent opening of the second pole 220 of the loss indicator limit switch 216 will not interrupt the flow of current to the loss indicator coil 222 since the second loss indicator relay switch 223 shunts the said second pole 220. Closing of the second loss indicator relay switch 223 in the second solenoid circuit 197 will allow current flow to the second solenoid 225, thus closing the normally open second solenoid operated valve 169 to further aid the handle 90 in returning to a vertical position, and will also allow current flow to the loss indicator light 226, which will become illuminated to indicate the loss to the user.

Opening of the first solenoid operated valve 167 and closing of the second solenoid operated valve 168 in the manner hereinabove described will cause the handle 90 to rotate to and through a vertical position; however, as the handle 90 passes through a vertical position it trips and opens the loss centering limit switch 221 in the second loss sequence circuit 195. Opening of the loss centering limit switch 221 interrupts current flow to the loss indicator relay coil 222 allowing the loss indicator relay switch 223 to open. Opening of the second loss indicator relay switch 223 in the second solenoid circuit 197 interrupts the current flow to the second solenoid 225 thereby reopening the second solenoid operated valve 168 and introducing equal pressure into both ends of both operating cylinders 28, 29 so that the arm 90 will remain in its vertical position. Current flow is also interrupted to the loss indicator light 226 causing the light to be extinguished.

If the user overcomes the opposing pressurized air, the arm 90 will rotate in such manner as to trip and close the win indicator limit switch 228 allowing current flow in the first win sequence circuit 199 to the win indicator relay coil 229 to operate and close the win indicator relay switch 230 in the first, second, and third win sequence circuits 199, 200, 201. It should be noted that, after a momentary closing of the start button switch 218 in the first loss sequence circuit 194, the start button relay switch 211 is kept close throughout a cycle of use by the start button relay coil 219 in the first loss sequence circuit 194.

Closing of the win indicator relay switch 230 in the first win sequence circuit 199 prevents an interruption of current flow to the win indicator relay coil 229 by a subsequent opening of the win indicator limit switch 228, which is shunted by the win indicator relay switch 230.

Closing of the win indicator relay switch 230 in the second win sequence circuit 200 allows current to flow to the stop relay coil 232 to operate and open the stop relay switch 217 in the first loss sequence circuit 194 when a wire centering limit switch 231 is closed. Opening of the stop relay switch 217 in the first loss sequence circuit 194 interrupts current to the start button relay coil 219 thereby opening the start button relay switch 211 in the locking cylinder control circuit 193, the first loss sequence circuit 194, the first solenoid circuit 196, and the first win sequence circuit 199. Opening of start button relay switch 211 in the four circuits 193, 194, 196, 199 just mentioned will have the same effects described above when the switch 211 is opened as a result of opening the loss indicator limit switch 213. It should be noted, however, that the start button relay switch 211 will not open until the win centering limit switch 231 is closed in the second win sequence circuit 200.

Closing of the win indicator relay switch 230 in the third win sequence circuit 201 will allow current to flow to a win indicator light 233 and to any one of a plurality of level-of-difficulty lights 234, 235, 236, 237 selected by a rotary selector switch 238, thereby illuminating the lights.

After winning, when a user releases the arm 90 it will automatically rotate back to and through a vertical position due to the pressurized air opposing the user's efforts. However, movement of the arm 90 back to the vertical position will momentarily close the win centering a limit switch 231 thereby momentarily allowing current to flow to the stop relay coil 232 in the second win sequence circuit 200 to operate and open the stop relay switch 217 in the first loss sequence circuit 194, interrupting current flow to the start button relay coil 219; opening the start button relay switch 211 in the locking cylinder control circuit, with no immediate effects for the reasons previously stated but with the delayed effects previously described in that circuit; interrupting current to the first solenoid 224 in the first solenoid circuit 196, thereby reopening the first solenoid operated valve 167; and interrupting current flow to the win indicator coil 229 in the first win sequence circuit 199, thereby opening the win indicator relay switch 230 in the second win sequence circuit 200 to interrupt current flow to the stop relay coil 232, and in the third win sequence circuit 201 to extinguish the win indicator light 233 and the level-of-difficulty light 234, 235, 236, 237. At that point the apparatus is ready for another attempt by the user.

Having thus described my invention, what I now claim is:

1. An arm wrestling apparatus comprising an upward extending handle having an upper end adapted to be grasped in the hand of a person and adapted to move through an arc of a circle and having a lower end adapted to be coupled to a gear assembly; first and second cylinder support means adapted to support the head ends of a pair of opposing pneumatic cylinders; first and second opposing pneumatic cylinders each comprising a hollow tubular member having a sealed head end pivotably coupled to a first or second cylinder support means and a sealed rod end, a piston slidably mounted within the said hollow tubular member for reciprocating lengthwise movement within the said tubular member, a piston rod having an internal end coupled to a said piston and an external end that extends through a said sealed rod end of a said tubular member and is adapted to be coupled to a rod pivot means, a first pneumatic hose connector means adapted to receive pressurized air into a said head end, and a second pneumatic hose connector means adapted to receive pressurized air into a said rod end; rod pivot means coupled to the said external ends of the said piston rods; a gear support means; gear means coupled to the said gear support means and to the said handle and to the said rod pivot means; an air compressor means adapted to supply pressurized air to the head ends and the said rod ends of the said pair of opposing pneumatic cylinders; regulator means adapted to regulate the pressure of the aforesaid pressurized air; a plurality of air hose means adapted to carry pressurized air from the said compressor means to the said head ends and the said rod ends of the said first and second pneumatic cylinders; a plurality of valve means adapted for selectively opening and closing air hose means of the said plurality of air hose means; a plurality of flow control means adapted to control the direction of flow of air in the said plurality of air hose means; display means adapted to be illuminated by electric lights and adapted to indicate the results of a cycle of use of the said arm wrestling apparatus; a plurality of electric light means adapted to illuminate the aforesaid display means and adapted to selectively indicate the results of a cycle of use of the said arm wrestling apparatus and adapted to be thereafter extinguished; a plurality of solenoid means adapted to control and change the state of the aforesaid plurality of valve means; a plurality of limit switch means adapted to be operated by moving the aforesaid upper end of the aforesaid handle through an arc of a circle and adapted to control a flow of electrical current to a plurality of relay switch means; a plurality of relay switch means adapted to be controlled by the said plurality of limit switch means and adapted to selectively control a flow of electrical current in a plurality of electrical conductor means; timer means adapted to measure the duration of an interval of time commencing with the closing a master switch means and adapted to interrupt after a prescribed period of time a flow of electrical current to the aforesaid plurality of solenoid means, the aforesaid plurality of electric light means, the aforesaid plurality of limit switch means, and the foresaid plurality of relay switch means; a master switch means adapted to control a flow of electrical current to the said timer means; a start switch means adapted to be operated by a user of the arm wrestling apparatus and adapted to selectively control a flow of electrical current to the aforesaid plurality of solenoid means; and electrical conductor means adapted to interconnect the said plurality of electric light means, the said plurality of solenoid means, the said plurality of limit switch means, the said plurality of relay switch means, the said air compressor means, the said timer means, the said master switch means, and the said start switch means, and adapted to be connected to a power source.

2. An arm wrestling apparatus comprising an upward extending handle having an upper end adapted to be grasped in the hand of a person and adapted to move through an arc of a circle and having a lower end adapted to be coupled to a gear assembly; first and second cylinder support means adapted to support the head ends of a pair of opposing pneumatic cylinders; first and second opposing pneumatic cylinders each comprising a hollow tubular member having a sealed head end pivotably coupled to a first or second cylinder support means and a sealed rod end, a piston slidably mounted within the said hollow tubular member for reciprocating lengthwise movement within the said tubular member, a piston rod having an internal end coupled to said piston and an external end that extends through a said sealed rod end of a said tubular member and is adapted to be coupled to a rod pivot means, a first pneumatic hose connecter means adapted to receive pressurized air into a said head end, and a second pneumatic hose connector means adapted to receive pressurized air into a said rod end; rod pivot means coupled to the said external ends of the said piston rods; a gear support means; gear means coupled to the said gear support means and to the said handle and to the said rod pivot means; pneumatic cylinder gear locking means comprising a hollow tubular member having a seated head end having provided therein a pneumatic hose connector means adapted to receive pressurized air into the said head end, a piston slidably mounted within the said hollow tubular member and adapted for reciprocating lengthwise movement within the said tubular member, a piston rod connected at one end of the said piston and adapted at the other end to engage and lock the aforesaid gear means and spring means adapted to retract the said rod and unlock the said gear means; air compressor means adapted to supply pressurized air to the said first and second opposing pneumatic cylinders and to the said pneumatic cylinder gear locking means; regulator means adapted to regulate the pressure of the aforesaid pressurized air; a plurality of air hose means adapted to carry pressurized air from the said compressor means to the said head ends and the said rod ends of the said first and second opposing pneumatic cylinders and the aforesaid pneumatic cylinder gear locking means; a plurality of valve means adapted for selectively opening and closing air hose means of the said plurality of air hose means; flow control means adapted to control the direction of flow of air in the said plurality of air hose means; display means adapted to be illuminated by electric lights and adapted to indicate the results of a cycle of use of the said arm wrestling apparatus; a plurality of electric light means adapted to illuminate the aforesaid display means and adapted to selectively indicate the results of a cycle of use of the said arm wrestling apparatus and adapted to be thereafter extinguished; a plurality of solenoid means adapted to control and change the state of the aforesaid plurality of valve means; a plurality of limit switch means adapted to be operated by moving the aforesaid upper end of the aforesaid handle through an arc of a circle and adapted to control a flow of electrical current to a plurality of relay switch means; a plurality of relay switch means adapted to be controlled by the said plurality of limit switch means and adapted to selectively control a flow of electrical current in a plurality of electrical conductor means; timer means adapted to measure the duration of an interval of time commencing with the closing a master switch means and adapted to interrupt after a prescribed period of time a flow of electrical current to the aforesaid plurality of solenoid means, the aforesaid plurality of electric light means, the aforesaid plurality of limit switch means, and the aforesaid plurality of relay switch means; a master switch means adapted to control a flow of electrical current to the said timer means; a start switch means adapted to be operated by a user of the arm wrestling apparatus and adapted to selectively control a flow of electrical current to the aforesaid plurality of solenoid means; and electrical conductor means adapted to interconnect the said plurality of electric light means, the said plurality of solenoid means, the said plurality of limit switch means, the said plurality of relay switch means, the said air compressor means, the said timer means, the said master switch means, and the said start switch means, and adapted to be connected to a power source.

* * * * *